US010612780B2

(12) United States Patent
Mulcaire

(10) Patent No.: US 10,612,780 B2
(45) Date of Patent: Apr. 7, 2020

(54) COMBUSTION CHAMBER ARRANGEMENT

(71) Applicant: ROLLS-ROYCE plc, London (GB)

(72) Inventor: Thomas G. Mulcaire, Derby (GB)

(73) Assignee: ROLLS-ROYCE PLC, London (GB)

( * ) Notice: Subject to any disclaimer, the term of this patent is extended or adjusted under 35 U.S.C. 154(b) by 340 days.

(21) Appl. No.: 15/843,006

(22) Filed: Dec. 15, 2017

(65) Prior Publication Data

US 2018/0187889 A1 Jul. 5, 2018

(30) Foreign Application Priority Data

Jan. 5, 2017 (GB) ..... 1700120.7

(51) Int. Cl.

| | |
|---|---|
| ***F23R 3/60*** | (2006.01) |
| ***F23R 3/00*** | (2006.01) |
| ***F23R 3/44*** | (2006.01) |
| ***F23R 3/10*** | (2006.01) |
| ***F23R 3/28*** | (2006.01) |

(52) U.S. Cl.

CPC ..... *F23R 3/002* (2013.01); *F23R 3/10* (2013.01); *F23R 3/283* (2013.01); *F23R 3/44* (2013.01); *F23R 3/60* (2013.01); *F23R 2900/00017* (2013.01); *F23R 2900/00019* (2013.01)

(58) Field of Classification Search

CPC .... F23R 3/002; F23R 3/50; F23R 3/60; F23R 2900/00017; F23R 2900/03041; F23R 2900/03042; F02C 7/20

See application file for complete search history.

(56) References Cited

U.S. PATENT DOCUMENTS

| | | | | |
|---|---|---|---|---|
| 4,686,823 | A | 8/1987 | Coburn et al. | |
| 6,904,757 | B2 * | 6/2005 | Mitchell | F23R 3/007 60/800 |
| 2005/0034459 | A1 * | 2/2005 | McMasters | F23R 3/002 60/752 |

(Continued)

FOREIGN PATENT DOCUMENTS

| | | |
|---|---|---|
| GB | 2528356 | 1/2016 |

OTHER PUBLICATIONS

Great Britain Search Report dated Apr. 20, 2017 issued in Great Britain Patent Application No. 1700120.7.

*Primary Examiner* — Gerald L Sung
*Assistant Examiner* — Rene D Ford
(74) *Attorney, Agent, or Firm* — Oliff PLC

(57) ABSTRACT

A combustion chamber arrangement comprises an annular combustion chamber, an outer casing, an inner casing and a stage of outlet guide vanes arranged at the downstream end of the combustion chamber interconnecting the outer casing and the inner casing. The combustion chamber comprises an upstream wall structure, a radially inner cowl is removably secured to a radially inner axially extending flange by fasteners and a radially outer wall structure and a radially outer cowl are removably secured to a radially outer axially extending flange by fasteners. The flange is slidably mounted on the radially inner wall structure. The flange has at least one recess in its radially inner surface and the fasteners are arranged in the recess in the radially inner surface of the flange. The cowl abuts the radially outer surface of the flange and the radially inner wall structure abuts the radially inner surface of the flange.

20 Claims, 4 Drawing Sheets

(56) References Cited

U.S. PATENT DOCUMENTS

| | | | | |
|---|---|---|---|---|
| 2008/0110174 | A1 | 5/2008 | Brown et al. | |
| 2013/0042627 | A1* | 2/2013 | Gerendas | F23R 3/10 60/782 |
| 2013/0081270 | A1* | 4/2013 | Patterson | F23R 3/002 29/888 |

* cited by examiner

COMBUSTION CHAMBER ARRANGEMENT

CROSS-REFERENCE TO RELATED APPLICATION

This application is based upon and claims the benefit of priority from British Patent Application No. 1700120.7 filed 5 Jan. 2017, the entire contents of which are incorporated herein.

FIELD OF THE DISCLOSURE

The present disclosure relates to a combustion chamber arrangement and in particular to a gas turbine engine combustion chamber arrangement.

BACKGROUND

A combustion chamber arrangement comprises an annular combustion chamber, an outer casing surrounding the annular combustion chamber, a plurality of fuel injectors arranged to supply fuel into the annular combustion chamber, an inner casing and a stage of combustion chamber outlet guide vanes arranged at the downstream end of the annular combustion chamber. The annular combustion chamber comprises an annular upstream end wall, a radially inner annular wall, a radially outer annular wall, a radially inner annular cowl and a radially outer annular cowl. The radially inner annular wall is secured to the annular upstream end wall, the radially outer annular wall is secured to the annular upstream end wall, the radially inner annular cowl is secured to the annular upstream end wall and the radially outer annular cowl is secured to the annular upstream end wall. The annular upstream end wall has a plurality of circumferentially spaced apertures, each fuel injector is arranged in a respective one of the apertures in the annular upstream end wall and each fuel injector is secured to the outer casing.

In one known arrangement the radially outer annular cowl and the radially outer annular wall are secured to the annular upstream end wall by a bolted joint and the radially inner annular cowl and the radially inner annular wall are secured to the annular upstream end wall by a bolted joint. The downstream end of the radially inner annular wall is mounted on the inner casing or the downstream end of the radially inner annular wall is mounted on the inner casing and the downstream end of the radially outer annular wall is mounted on the outer casing such that the downstream end of the inner annular wall is constrained at least axially to the inner casing or the downstream ends of the inner and outer annular walls are constrained at least axially to the respective inner and outer casings.

A disadvantage of this arrangement is that the axial loads applied to the inner casing and the thermal expansion of the inner casing results in considerable movement of the inner casing relative to the outer casing. The annular combustion chamber is constrained axially to the inner casing or the radially inner ends of the stage of combustion chamber outlet guide vanes and hence a stress is induced in the annular combustion chamber as the inner and outer casing move relative to each other during operation of the gas turbine engine.

In another known arrangement the radially inner annular cowl and the radially outer annular cowl are integral with the annular upstream end wall and are produced by casting, the radially outer annular wall is secured to the annular upstream end wall by brazing or welding and the radially inner annular wall is slidably mounted on the annular upstream end wall. The annular upstream end wall is mounted on the outer casing and the downstream end of the radially inner annular wall is mounted on the inner casing.

A disadvantage of this arrangement is that it is difficult and expensive to manufacture the annular combustion chamber and it is difficult to assemble, disassemble and repair the annular combustion chamber.

The present disclosure seeks to produce a combustion chamber arrangement which reduces, or overcomes, the above mentioned problem.

BRIEF SUMMARY OF THE DISCLOSURE

According to a first aspect of the disclosure there is provided a combustion chamber arrangement comprising an annular combustion chamber, an inner casing, an outer casing and a stage of combustion chamber outlet guide vanes, the outer casing surrounding the annular combustion chamber, the annular combustion chamber surrounding the inner casing, the stage of combustion chamber outlet guide vanes being arranged at the downstream end of the annular combustion chamber, the stage of combustion chamber outlet guide vanes interconnecting the outer casing and the inner casing, the annular combustion chamber comprising an annular upstream end wall structure, a radially inner annular wall structure, a radially outer annular wall structure, a radially inner annular cowl and a radially outer annular cowl, the annular upstream end wall structure having a radially inner axially extending flange and a radially outer axially extending flange, the radially inner annular cowl being removably secured to the radially inner axially extending flange, the radially outer annular cowl being removably secured to the radially outer axially extending flange, the radially inner axially extending flange being slidably mounted on the radially inner annular wall structure, the downstream end of the radially inner annular wall structure being mounted on the inner casing or the stage of combustion chamber outlet guide vanes and the annular upstream end wall structure being mounted on the outer casing or the downstream end of the radially outer annular wall structure being mounted on the outer casing, and the radially inner axially extending flange being secured to the radially inner annular cowl by a plurality of circumferentially spaced radially extending fasteners, the radially inner annular extending flange having at least one recess in its radially inner surface, the fasteners being arranged in the at least one recess in the radially inner surface of the radially inner annular extending flange, the radially inner annular cowl abutting the radially outer surface of the radially inner axially extending flange and the radially inner annular wall structure abutting the radially inner surface of the radially inner axially extending flange.

The radially inner axially extending flange may be secured to the radially inner annular cowl by a plurality of circumferentially spaced radially extending bolts and cooperating nuts, the heads of the bolts or the nuts being arranged in the at least one recess in the radially inner surface of the radially inner annular extending flange.

The radially inner axially extending flange may be secured to the radially inner annular cowl by a plurality of circumferentially spaced radially extending screws and cooperating nuts, the heads of the screws or the nuts being arranged in the at least one recess in the radially inner surface of the radially inner annular extending flange.

The radially inner axially extending flange may be secured to the radially inner annular cowl by a plurality of circumferentially spaced radially extending rivets, the heads of the rivets being arranged in the at least one recess in the radially inner surface of the radially inner annular extending flange.

The at least one recess may be an annular groove or a plurality of circumferentially spaced recesses, e.g. a plurality of circumferentially spaced circumferentially extending grooves.

The radially outer axially extending flange may be removably secured to the radially outer annular cowl and the radially outer annular wall structure by a plurality of circumferentially spaced radially extending fasteners, the radially outer annular cowl abutting the radially inner surface of the radially outer axially extending flange and the radially outer annular wall structure abutting the radially outer surface of the radially outer axially extending flange.

The radially outer axially extending flange may be secured to the radially outer annular cowl and the radially outer annular wall structure by a plurality of circumferentially spaced radially extending bolts and cooperating nuts.

The radially outer axially extending flange may be removably secured to the radially outer annular cowl by a plurality of circumferentially spaced radially extending fasteners, the radially outer annular cowl abutting the radially inner surface of the radially outer axially extending flange and the radially outer annular wall structure abutting the radially outer surface of the radially outer axially extending flange.

The radially outer axially extending flange may be secured to the radially outer annular cowl by a plurality of circumferentially spaced radially extending bolts and cooperating nuts.

The radially outer annular wall structure may be welded or brazed to the radially outer axially extending flange.

The radially inner axially extending flange and the radially outer axially extending flange may extend in an axially upstream direction from the annular upstream end wall structure.

The radially inner annular structure may overlap the at least one recess in the radially inner axially extending flange. The radially inner annular structure may abut the radially inner surface at both sides of the at least one recess in the radially inner axially extending flange. The upstream end of the radially inner axially extending flange may be tapered, the upstream end of the radially inner axially extending flange decreasing in thickness in an axially upstream direction to a leading edge. The inner diameter of the upstream end of the radially inner axially extending flange may be less than the inner diameter of the upstream end of the radially inner annular wall structure.

The upstream end of the radially outer axially extending flange may be tapered, the upstream end of the radially outer axially extending flange increasing in thickness from a leading edge to a maximum thickness. The outer diameter of the tapered upstream end of the radially outer axially extending flange may be more than the outer diameter of the upstream end of the radially outer annular wall structure. The heads of the bolts or the nuts may be located behind the tapered upstream end of the radially outer axially extending flange.

The radially inner surface of the radially outer axially extending flange may have an axial stop for the radially outer annular cowl. The radially inner surface of the radially outer axially extending flange may have an axial stop for the radially outer annular cowl. The radially inner annular cowl and the radially outer annular cowl may be integral.

The radially inner surface of the radially inner axially extending flange may have a wear resistant coating. The radially outer surface of the upstream end of the radially inner annular wall structure may have a wear resistant coating.

The radially inner axially extending flange and the radially outer axially extending flange are parallel to the axis of the annular combustion chamber.

The annular upstream end wall structure may comprise an annular upstream end wall and a plurality of heat shields positioned downstream of and supported by the annular upstream end wall, the radially inner axially extending flange and the radially outer axially extending flange being integral with the annular upstream end wall.

The radially outer annular wall structure may comprise an annular wall, the upstream end of the annular wall being secured to the radially outer axially extending flange.

The radially outer annular wall structure may comprise an annular wall and a plurality of tiles arranged radially within and supported by the annular wall, the upstream end of the annular wall being secured to the radially outer axially extending flange. There may be one or more rows of circumferentially arranged tiles.

The radially outer annular wall structure may comprise a plurality of circumferentially arranged wall segments, the upstream end of each wall segment being secured to the radially outer axially extending flange. Each segment may comprise a box structure having a radially inner wall and a radially outer wall.

The radially inner annular wall structure may comprise an annular wall, the upstream end of the annular wall being slidably mounted on the radially inner axially extending flange.

The radially inner annular wall structure may comprise an annular wall and a plurality of tiles arranged radially around and supported by the annular wall, the upstream end of the annular wall being slidably mounted on the radially inner axially extending flange. There may be one or more rows of circumferentially arranged tiles.

The radially inner annular wall structure may comprise a plurality of circumferentially arranged wall segments, the upstream end of each wall segment being secured to a ring and the ring being slidably mounted on the radially inner axially extending flange. Each segment may comprise a box structure having a radially inner wall and a radially outer wall.

The fuel injector may be a rich burn fuel injector or a lean burn fuel injector.

The combustion chamber may be a gas turbine engine combustion chamber.

The gas turbine engine may be an industrial gas turbine engine, an automotive gas turbine engine, a marine gas turbine engine or an aero gas turbine engine.

The aero gas turbine engine may be a turbofan gas turbine engine, a turbojet gas turbine engine, a turbo-propeller gas turbine engine or a turbo-shaft gas turbine engine.

The skilled person will appreciate that except where mutually exclusive, a feature described in relation to any one of the above aspects of the disclosure may be applied mutatis mutandis to any other aspect of the disclosure.

BRIEF DESCRIPTION OF THE DRAWINGS

Embodiments of the disclosure will now be described by way of example only, with reference to the Figures, in which.

DETAILED DESCRIPTION OF THE DISCLOSURE

Figure 1:
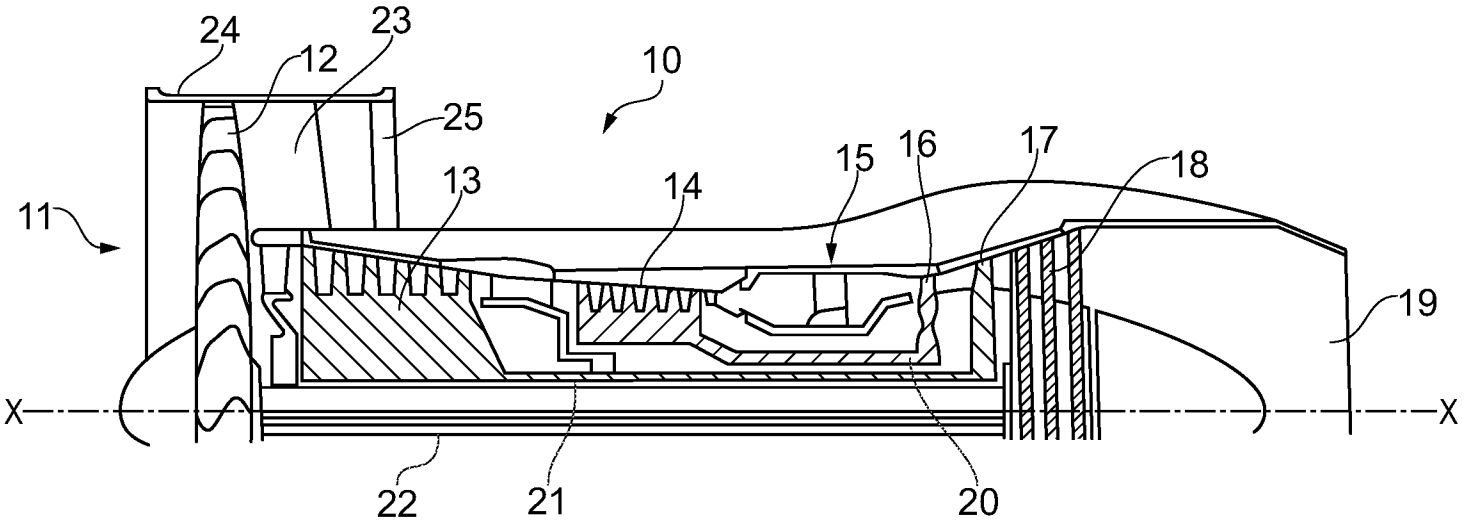
FIG. 1 is a sectional side view of a gas turbine engine having a combustion chamber arrangement according to the present disclosure.

With reference to FIG. 1, a gas turbine engine is generally indicated at 10, having a principal and rotational axis X-X. The engine 10 comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and an exhaust nozzle 19. A fan nacelle 24 generally surrounds the fan 12 and defines the intake 11 and a fan duct 23. The fan nacelle 24 is secured to the core engine by fan outlet guide vanes 25.

The gas turbine engine 10 works in the conventional manner so that air entering the intake 11 is compressed by the fan 12 to produce two air flows: a first air flow into the intermediate pressure compressor 13 and a second air flow which passes through the bypass duct 23 to provide propulsive thrust. The intermediate pressure compressor 13 compresses the air flow directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high 16, intermediate 17 and low 18 pressure turbines drive respectively the high pressure compressor 14, the intermediate pressure compressor 13 and the fan 12, each by suitable interconnecting shaft 20, 21 and 22 respectively.

Figure 2:
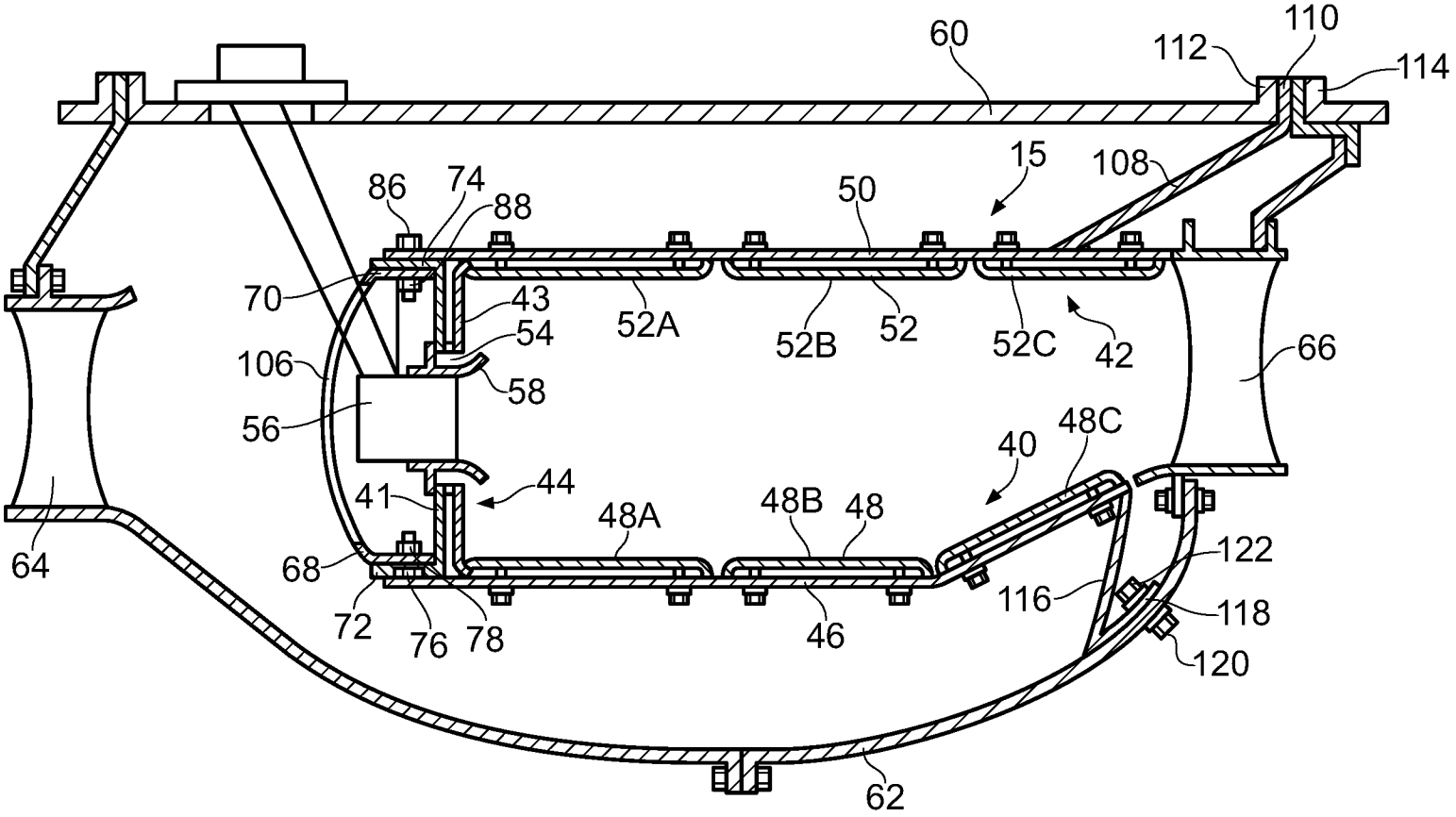
FIG. 2 is an enlarged cross-sectional view through a combustion chamber arrangement according to the present disclosure.

The combustion chamber 15, as shown more clearly in FIG. 2, is an annular combustion chamber and comprises a radially inner annular wall structure 40, a radially outer annular wall structure 42 and an upstream end wall structure 44. The radially inner annular wall structure 40 comprises a first annular wall 46 and a second annular wall 48. The radially outer annular wall structure 42 comprises a third annular wall 50 and a fourth annular wall 52. The second annular wall 48 is spaced radially from and is arranged radially around the first annular wall 46 and the first annular wall 46 supports the second annular wall 48. The fourth annular wall 52 is spaced radially from and is arranged radially within the third annular wall 50 and the third annular wall 50 supports the fourth annular wall 52. The upstream end wall structure 44 comprises an upstream end wall 41 and a plurality of heat shields 43. The heat shields 43 are spaced axially from and are arranged axially downstream of the upstream end wall 41 and the upstream end wall 41 supports the heat shields 43. The upstream end of the first annular wall 46 is secured to the upstream end wall 41 of the upstream end wall structure 44 and the upstream end of the third annular wall 50 is secured to the upstream end wall 41 of the upstream end wall structure 44. The upstream end wall structure 44 has a plurality of circumferentially spaced apertures 54 and each aperture 54 extends through the upstream end wall 41 and a respective one of the heat shield 43. The combustion chamber 15 also comprises a plurality of fuel injectors 56 and a plurality of seals 58. Each fuel injector 56 is arranged in a corresponding one of the apertures 54 in the upstream end wall structure 44 and each seal 58 is arranged in a corresponding one of the apertures 54 in the upstream end wall structure 44 and each seal 58 is arranged around, e.g. surrounds, the corresponding one of the fuel injectors 56. The fuel injectors 56 are arranged to supply fuel into the annular combustion chamber 15 during operation of the gas turbine engine 10. The second annular wall 48 comprises a plurality of rows of combustion chamber tiles 48A, 48B and 48C and the fourth annular wall 52 comprises a plurality of rows of combustion chamber tiles 52A, 52B and 52C. The combustion chamber tiles 48A, 48B and 48C are secured onto the first annular wall 46 by threaded studs, washers and nuts and the combustion chamber tiles 52A, 52B and 52C are secured onto the third annular wall 50 by threaded studs, washers and nuts. The heat shields 43 are secured onto the upstream end wall 41 by threaded studs, washers and nuts. The heat shields 43 are arranged circumferentially side by side in a row.

An outer casing 60 surrounds, is arranged radially outside, the annular combustion chamber 15 and the annular combustion chamber 15 surrounds, is arranged radially outside, an inner casing 62. A stage of compressor outlet guide vanes 64 is arranged at the downstream end of the high pressure compressor 14 and the stage of compressor outlet guide vanes 64 interconnects the outer casing 60 and the inner casing 62. A stage of combustion chamber outlet guide vanes, also known as high pressure turbine inlet guide vanes, 66 is arranged at the downstream end of the annular combustion chamber 15 and upstream of the high pressure turbine 16 and the stage of combustion chamber outlet guide vanes 66 interconnects the outer casing 60 and the inner casing 62.

Figure 3:
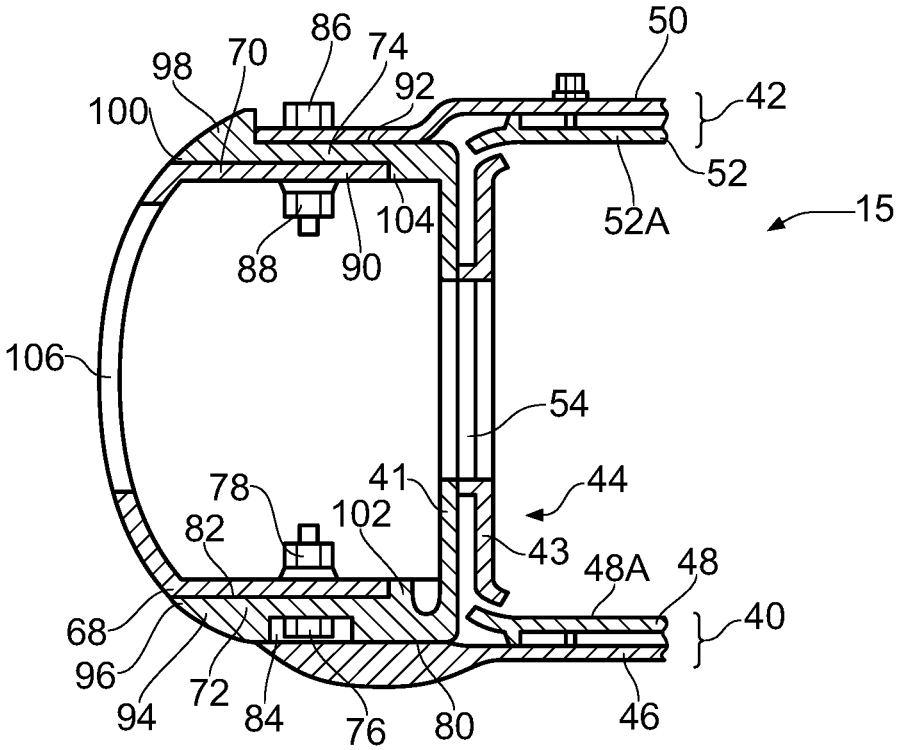
FIG. 3 is a further enlarged cross-sectional view through an upstream end of an annular combustion chamber of a combustion chamber arrangement according to the present disclosure.

The upstream end of the annular combustion chamber 15 is shown more clearly in FIG. 3. The annular combustion chamber 15 also comprises a radially inner annular cowl 68 and a radially outer annular cowl 70. The annular upstream end wall structure 44 has a radially inner axially extending flange 72 and a radially outer axially extending flange 74. The radially inner axially extending flange 72 and the radially outer axially extending flange 74 are integral, form a one piece structure or monolithic structure, with the annular upstream end wall 41. The radially inner annular cowl 68 is removably secured to the radially inner axially extending flange 72, the radially outer annular cowl 70 and the radially outer annular wall structure 42 is removably secured to the radially outer axially extending flange 74 and the radially inner axially extending flange 72 is slidably mounted on the radially inner annular wall structure 40. The downstream end of the radially inner annular wall structure 40 is mounted on the inner casing 62 or is mounted on the stage of combustion chamber outlet guide vanes 66 such that the radially inner annular wall structure 40 is constrained axially. The annular upstream end wall structure 44 is mounted on the outer casing 60 or the downstream end of the radially outer annular wall structure 42 is mounted on the outer casing 60 such that the annular upstream end wall structure 44 or the radially outer annular wall structure 42 is constrained axially.

The radially inner axially extending flange 72 is secured to the radially inner annular cowl 68 by a plurality of circumferentially spaced radially extending bolts 76 and cooperating nuts 78. The radially inner annular extending flange 72 has at least one recess 84 in its radially inner surface 80 and the heads of the bolts 76 or the nuts 78 are arranged in the at least one recess 84 in the radially inner surface 80 of the radially inner annular extending flange 72. The radially inner annular cowl 68 abuts the radially outer surface 82 of the radially inner axially extending flange 72 and the radially inner annular wall structure 40 abuts the radially inner surface 80 of the radially inner axially extending flange 72.

In this example the at least one recess 84 is an annular groove and the heads of all of the bolts 76, all of the nuts 78 or the heads of some of the bolts 76 and some of the nuts 78 may be located in the annular groove 84. The annular groove 84 is wide enough to accommodate the heads of the bolts 76, or the nuts 78, and the tooling for tightening the bolts 76, or the nuts 78, and the annular groove 84 is deep enough such that the heads of the bolts 76, or the nuts 78, are always under flush to the radially inner surface 80 of the radially inner annular extending flange 72 to enable the radially inner annular wall structure 40 to slide over the radially inner surface 80 of the radially inner extending flange 72. In other words the depth of the annular groove 84 is such that the heads of the bolts 76, or the nuts 78 and threaded portions of the bolts 76, do not protrude from the annular groove 84. However, the at least one recess 84 may be a plurality of circumferentially spaced recesses, e.g. a plurality of circumferentially spaced circumferentially extending grooves and the head of at least one bolt 76, or at least one nut 78, may be located in each of the circumferentially spaced recesses 84. Each recess 84 is wide enough and long enough to accommodate the heads of the bolts 76, or the nuts 78, and the tooling for tightening the bolts 76, or the nuts 78, and the recess 84 is deep enough such that the heads of the bolts 76, or the nuts 78, are always under flush to the radially inner surface 80 of the radially inner annular extending flange 72 to enable the radially inner annular wall structure 40 to slide over the radially inner surface 80 of the radially inner extending flange 72. In other words the depth of each recess 84 is such that the heads of the bolts 76, or the nuts 78 and threaded portions of the bolts 76, do not protrude from the recesses 84.

The radially outer axially extending flange 74 is secured to the radially outer annular cowl 70 and the radially outer annular wall structure 42 by a plurality of circumferentially spaced radially extending bolts 86 and cooperating nuts 88. The radially outer annular cowl 70 abuts the radially inner surface 90 of the radially outer axially extending flange 74 and the radially outer annular wall structure 42 abuts the radially outer surface 92 of the radially outer axially extending flange 74.

However, the radially outer axially extending flange 74 may be secured to the radially outer annular cowl 70 by a plurality of circumferentially spaced radially extending bolts 86 and cooperating nuts 88. The radially outer annular cowl abuts the radially inner surface 90 of the radially outer axially extending flange 74 and the radially outer annular wall structure 42 abuts the radially outer surface 92 of the radially outer axially extending flange 74 and the radially outer annular wall structure 42 may be welded or brazed to the radially outer axially extending flange 74.

The radially inner axially extending flange 72 and the radially outer axially extending flange 74 extend in an axially upstream direction from the annular upstream end wall structure 44.

As shown in FIG. 3 the upstream end of the radially inner annular wall structure 40 overlaps the at least one recess 84 in the radially inner axially extending flange 72 and the radially inner annular wall structure 40 abuts the radially inner surface 80 at both axial sides of the at least one recess 84 in the radially inner axially extending flange 72. The upstream end 94 of the radially inner axially extending flange 72 is tapered, e.g. the upstream end 94 of the radially inner axially extending flange 72 decreases in thickness in an axially upstream direction to a leading edge 96. Similarly, the upstream end of the radially inner annular wall structure 40 is tapered, e.g. the upstream end of the radially inner annular wall structure 40 decreases in thickness in an axially upstream direction to a leading edge. The upstream end of the radially inner annular wall structure 40 is designed to cover the annular groove 84 under all conditions of relative movement of the radially inner annular wall structure 40 and the upstream end wall structure 44. The upstream end of the radially inner annular flange 72 and the upstream end of the radially inner annular wall structure 40 provide a smooth aerodynamic surface as a continuation of the radially inner annular cowl 68. Thus, the radially inner annular wall structure 40 is free to slide relative to the upstream end wall structure 40 without interference from the bolts 76 or nuts 78 fastening the radially inner annular cowl 68 to the radially inner axially extending annular flange 72. The radially inner surface 80 of the radially inner axially extending flange 72 both sides of the annular groove 84 are shown to be of equal diameter and both form part of the sliding joint to the upstream end of the radially inner annular wall structure 40.

The upstream end wall 41 may be manufactured by casting, or forging, and then machined to produce the cylindrical radially inner surface 80 of the radially inner axially extending flange 72, the cylindrical radially outer surface of the radially outer axially extending flange 74 and machined, e.g. turned, to produce the annular groove 84 in the cylindrical radially inner surface 80.

The upstream end 98 of the radially outer axially extending flange 74 is tapered, e.g. the upstream end 98 of the radially outer axially extending flange 74 increases in thickness from a leading edge 100 to a maximum thickness. The outer diameter of the tapered upstream end 98 of the radially outer axially extending flange 74 is greater than the outer diameter of the upstream end of the radially outer annular wall structure 42. The heads of the bolts 86 or the nuts 88 are located behind, axially downstream of, the tapered upstream end 98 of the radially outer axially extending flange 74.

The radially outer surface 82 of the radially inner axially extending flange 72 has an axial stop 102 for the radially inner annular cowl 68 and the radially inner surface 90 of the radially outer axially extending flange 74 has an axial stop 104 for the radially outer annular cowl 70. The radially inner annular cowl 68 and the radially outer annular cowl 70 are integral, e.g. a one piece structure, and define a plurality of apertures 106, one for each fuel injector 56. Each aperture 106 is aligned with a corresponding one of the apertures 54 in the upstream end wall 41.

The radially inner surface 80 of the radially inner axially extending flange 72 has a wear resistant coating and/or the radially outer surface of the upstream end of the radially inner annular wall structure 40 has a wear resistant coating.

The radially inner axially extending flange 72 and the radially outer axially extending flange 74 are parallel to the axis X-X of the annular combustion chamber 15.

The third annular wall 50 of the radially outer annular wall structure 42 is mounted on the outer casing 60 by a frustoconical wall 108. The frustoconical wall 108 extends radially outwardly and in a downstream direction from the downstream end of the third annular wall 50 and has a flange 110 which is located between two flanges 112 and 114 on portions of the outer casing 60. The first annular wall 46 of the radially inner annular wall structure 40 is mounted on the inner casing 62 by a flange 116. The flange 116 extends radially inwardly from the downstream end of the first annular wall 46 and the flange 116 has a portion 118 which abuts and is secured to the inner casing 62 by nuts 122 and bolts 120.

Figure 4:
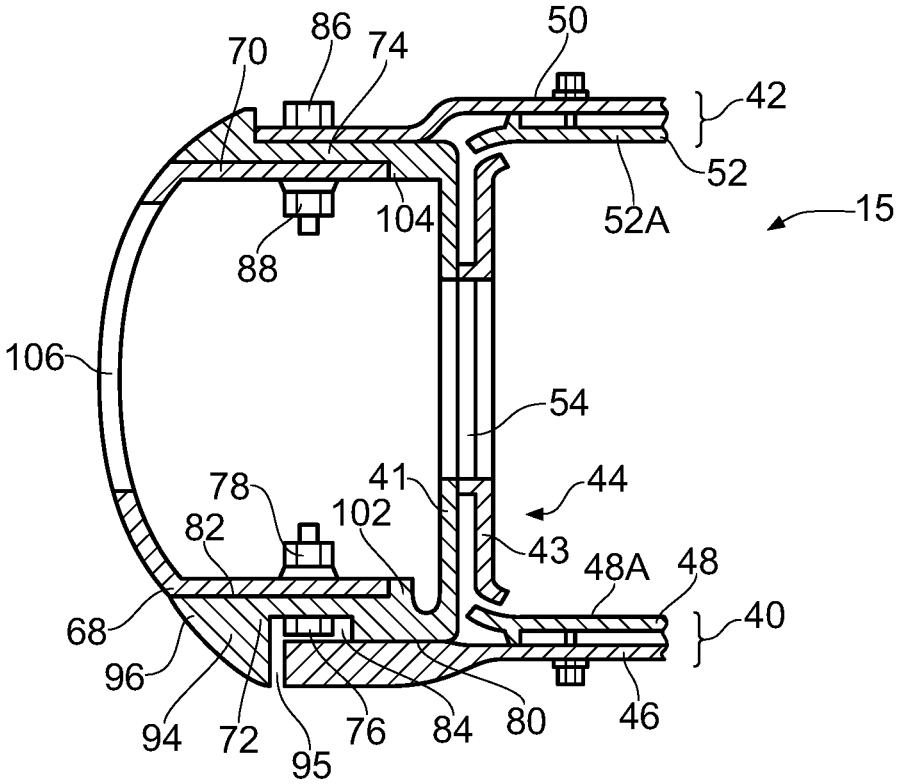
FIG. 4 is an alternative further enlarged cross-sectional view through an upstream end of an annular combustion chamber of a combustion chamber arrangement according to the present disclosure.

In another arrangement as shown in FIG. 4, the radially inner annular wall structure 40 overlaps the at least one recess 84 in the radially inner axially extending flange 72 and the radially inner annular wall structure 40 abuts the radially inner surface 80 only at the axial downstream side of the at least one recess 84 in the radially inner axially extending flange 72. The inner diameter of the upstream end 94 of the radially inner axially extending flange 72 is less than the inner diameter of the upstream end of the radially inner annular wall structure 40, and the upstream end 94 of the radially inner axially extending flange 72 is positioned axially upstream of the upstream end of the radially inner annular wall structure 40. An axial gap, or clearance, is provided between the upstream end 94 of the radially inner axially extending flange 72 and the upstream end of the first annular wall 46 of the radially inner annular wall structure 40 to allow relative axial movement there-between such that the relative axial movement does not result in these components touching each other.

Figure 5:
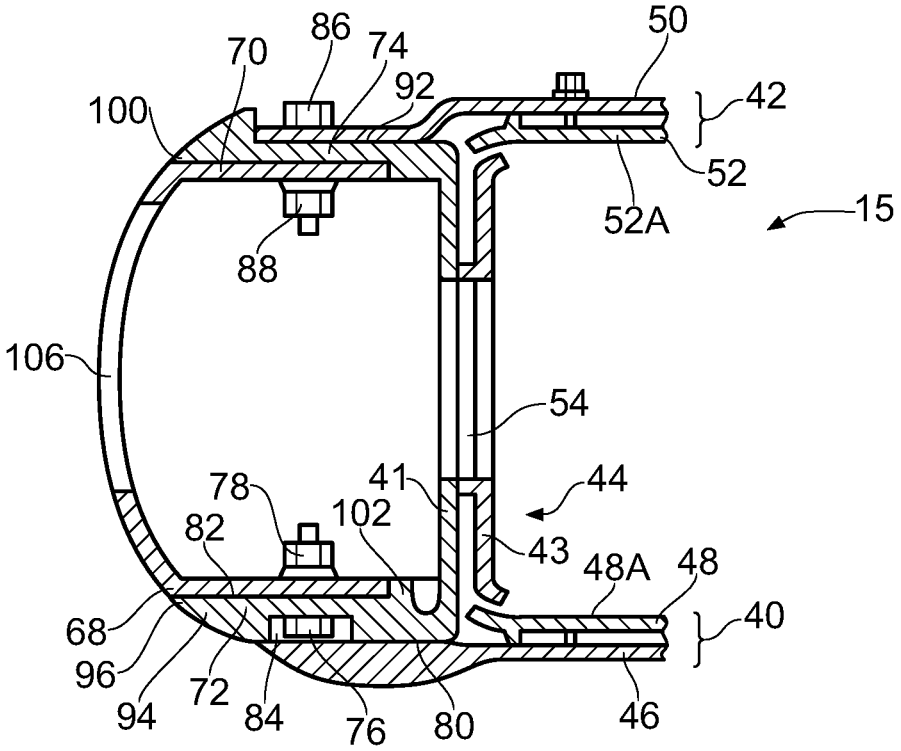
FIG. 5 is another further enlarged cross-sectional view through an upstream end of an annular combustion chamber of a combustion chamber arrangement according to the present disclosure.

In a further arrangement as shown in FIG. 5, which is similar to FIG. 3, the radially outer annular cowl 70 abuts the radially outer surface 92 of the radially outer axially extending flange 74 and the radially outer annular wall structure 42 abuts the radially outer surface of the radially outer annular cowl 70, e.g. the radially outer annular cowl 70 is sandwiched, located, radially between the radially outer annular wall structure 42 and the radially outer axially extending flange 74.

Figure 6:
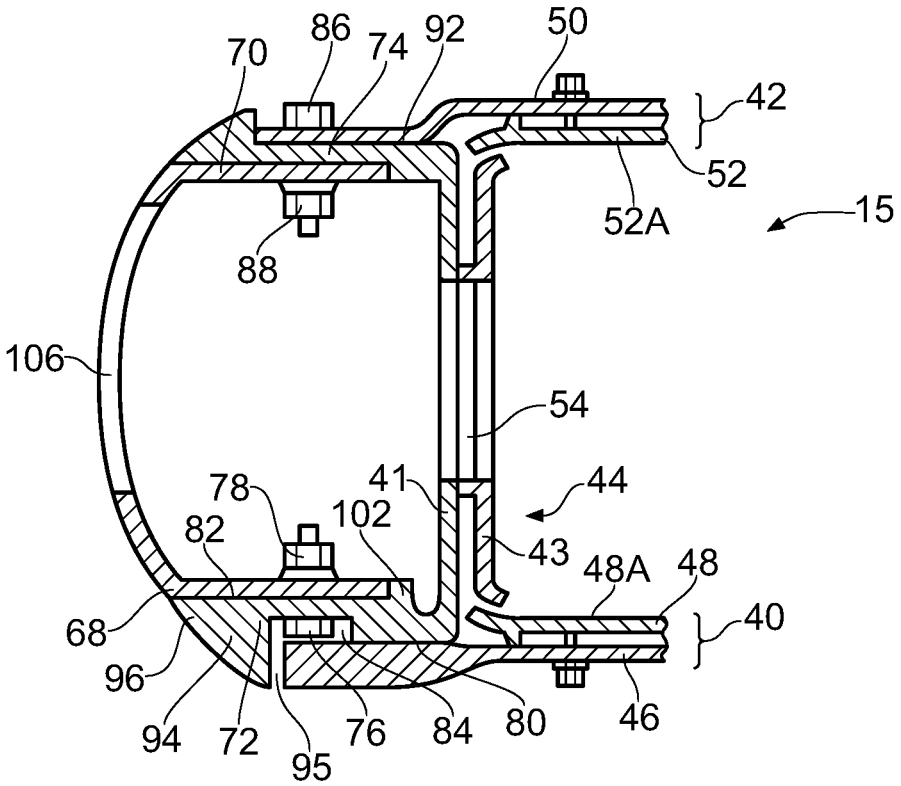
FIG. 6 is an additional further enlarged cross-sectional view through an upstream end of an annular combustion chamber of a combustion chamber arrangement according to the present disclosure.

In an additional arrangement as shown in FIG. 6, which is similar to FIG. 4, the radially outer annular cowl 70 abuts the radially outer surface of the radially outer annular wall structure 42 and the radially outer annular wall structure 42 abuts the radially outer surface 92 of the radially outer axially extending flange 74, e.g. the radially outer annular wall structure 42 is sandwiched, located, radially between the radially outer annular cowl 70 and the radially outer axially extending flange 74.

The arrangement of the radially outer annular cowl 70, the radially outer axially extending flange 74 and the radially outer annular wall structure 42 shown in FIG. 5 may be used in the arrangement of FIG. 4. The arrangement of the radially outer annular cowl 70, the radially outer axially extending flange 74 and the radially outer annular wall structure 42 shown in FIG. 6 may be used in the arrangement of FIG. 3.

The advantage of the present disclosure is that it uses a bolted joint to secure the radially outer annular cowl and the radially outer annular wall to the annular upstream end wall, it uses a bolted joint to secure the radially inner annular cowl to the annular upstream end wall but allows the radially inner annular wall to slide relative to the upstream end wall. The present disclosure reduces the cost of manufacturing the annular combustion chamber and makes it easier to manufacture, assemble and repair the annular combustion chamber. The present disclosure enables an annular combustion chamber to have a bolted construction at its upstream end while having a sliding joint between the upstream end of the annular combustion chamber and the radially inner annular wall.

Although the present disclosure has been described with reference to the downstream end of the third annular wall of the radially outer annular wall structure being mounted on the outer casing by a frustoconical wall, it may be possible to mount the downstream end of the third annular wall on the outer casing by other means, for example by mounting on the stage of combustion chamber outlet guide vanes or it may be possible to mount the upstream end wall structure on the outer casing, for example by a plurality of circumferentially spaced radially extending pins. Although the present disclosure has been described with reference to the downstream end of the first annular wall of the radially inner annular wall structure being mounted on the inner casing by a flange, it may be possible to mount the downstream end of the third annular wall on the outer casing by other means, for example by mounting on the stage of combustion chamber outlet guide vanes Although the present disclosure has been described with reference to the use of bolts and nuts to removably secure the radially inner annular cowl to the radially inner axially extending flange other suitable fasteners may be used for example screws and nuts, rivets etc. The heads of all of the screws, all of the nuts or the heads of some of the screws and some of the nuts are located in the at least one recess in the radially inner axially extending flange, e.g. the annular groove or the plurality of circumferentially spaced recesses. One head of each of the rivets are located in the at least one recess in the radially inner axially extending flange, e.g. the annular groove or the plurality of circumferentially spaced recesses. Although the present disclosure has been described with reference to the use of bolts and nuts to removably secure the radially outer annular cowl to the radially outer axially extending flange other suitable fasteners may be used for example screws and nuts, rivets etc. The heads of all of the screws, all of the nuts or the heads of some of the screws and some of the nuts are located behind the upstream end of the radially outer axially extending flange. One head of each of the rivets are located behind the upstream end of the radially outer axially extending flange. Although the present disclosure has been described with reference to the use of bolts and nuts to removably secure the radially outer annular wall structure to the radially outer axially extending flange other suitable fasteners may be used for example screws and nuts, rivets etc.

Although the present disclosure has been described with reference to a separate radially inner annular cowl and a separate radially outer annular cowl it may be possible for the radially inner annular cowl and the radially outer annular cowl to be integral, e.g. a single piece or a monolithic piece.

Although the present disclosure has been described with reference to the radially outer annular wall structure comprising an annular wall and a plurality of rows of tiles arranged radially within and supported by the annular wall, the upstream end of the annular wall being secured to the radially outer axially extending flange, the radially outer annular wall structure may comprise an annular wall and a single row of combustion chamber tiles which extend substantially the full length of the combustion chamber.

Although the present disclosure has been described with reference to the radially outer annular wall structure comprising an annular wall and a plurality of rows of tiles arranged radially within and supported by the annular wall, the upstream end of the annular wall being secured to the radially outer axially extending flange, the radially outer annular wall structure may simply comprise an annular wall, the upstream end of the annular wall being secured to the radially outer axially extending flange. Alternatively, the radially outer annular wall structure may comprise a plurality of circumferentially arranged wall segments, the upstream end of each wall segment being secured to the radially outer axially extending flange. Each segment may comprise a box structure having a radially inner wall and a radially outer wall.

Although the present disclosure has been described with reference to the radially inner annular wall structure comprising an annular wall and a plurality of rows of tiles arranged radially around and supported by the annular wall, the upstream end of the annular wall being slidably mounted on the radially inner axially extending flange, the radially inner annular wall structure may comprise an annular wall and a single row of combustion chamber tiles which extend substantially the full length of the combustion chamber.

Although the present disclosure has been described with reference to the radially inner annular wall structure comprising an annular wall and a plurality of tiles arranged radially around and supported by the annular wall, the upstream end of the annular wall being slidably mounted on the radially inner axially extending flange, the radially inner annular wall structure may comprise an annular wall, the upstream end of the annular wall being slidably mounted on the radially inner axially extending flange. Alternatively, the radially inner annular wall structure may comprise a plurality of circumferentially arranged wall segments, the upstream end of each wall segment being secured to a ring and the ring being slidably mounted on the radially inner axially extending flange. Each segment may comprise a box structure having a radially inner wall and a radially outer wall.

The fuel injector may be a rich burn fuel injector or a lean burn fuel injector.

The combustion chamber may be a gas turbine engine combustion chamber.

The gas turbine engine may be an industrial gas turbine engine, an automotive gas turbine engine, a marine gas turbine engine or an aero gas turbine engine.

The aero gas turbine engine may be a turbofan gas turbine engine, a turbojet gas turbine engine, a turbo-propeller gas turbine engine or a turbo-shaft gas turbine engine.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A combustion chamber arrangement comprising an annular combustion chamber, an inner casing, an outer casing and a stage of combustion chamber outlet guide vanes, the outer casing surrounding the annular combustion chamber, the annular combustion chamber surrounding the inner casing, the stage of combustion chamber outlet guide vanes being arranged at a downstream end of the annular combustion chamber, the stage of combustion chamber outlet guide vanes interconnecting the outer casing and the inner casing, the annular combustion chamber comprising an annular upstream end wall structure, a radially inner annular wall structure, a radially outer annular wall structure, a radially inner annular cowl and a radially outer annular cowl, the annular upstream end wall structure having a radially inner axially extending flange and a radially outer axially extending flange, the radially inner annular cowl being removably secured to the radially inner axially extending flange, the radially outer annular cowl being removably secured to the radially outer axially extending flange, the radially inner axially extending flange being slidably mounted on the radially inner annular wall structure, a downstream end of the radially inner annular wall structure being mounted on the inner casing or the stage of combustion chamber outlet guide vanes and the annular upstream end wall structure being mounted on the outer casing or a downstream end of the radially outer annular wall structure being mounted on the outer casing, and the radially inner axially extending flange being secured to the radially inner annular cowl by a plurality of circumferentially spaced radially extending fasteners, a radially inner surface of the radially inner axially extending flange having at least one recess, the fasteners being arranged in the at least one recess in the radially inner surface of the radially inner axially extending flange, the radially inner annular cowl abutting a radially outer surface of the radially inner axially extending flange and the radially inner annular wall structure abutting the radially inner surface of the radially inner axially extending flange.

2. A combustion chamber arrangement as claimed in claim 1 wherein the plurality of circumferentially spaced radially extending fasteners comprises a plurality of circumferentially spaced radially extending bolts or screws and cooperating nuts, heads of the bolts, heads of the screws or the nuts being arranged in the at least one recess in the radially inner surface of the radially inner axially extending flange.

3. A combustion chamber arrangement as claimed in claim 1 wherein the plurality of circumferentially spaced radially extending fasteners comprises a plurality of circumferentially spaced radially extending rivets, heads of the rivets being arranged in the at least one recess in the radially inner surface of the radially inner axially extending flange.

4. A combustion chamber arrangement as claimed in claim 1 wherein the at least one recess being an annular groove or a plurality of circumferentially spaced recesses.

5. A combustion chamber arrangement as claimed in claim 1 wherein the radially outer axially extending flange being removably secured to the radially outer annular cowl and the radially outer annular wall structure by a second plurality of circumferentially spaced radially extending fasteners, the radially outer annular cowl abutting a radially inner surface of the radially outer axially extending flange and the radially outer annular wall structure abutting a radially outer surface of the radially outer axially extending flange.

6. A combustion chamber as claimed in claim 5 wherein the second plurality of circumferentially spaced radially extending fasteners comprises a plurality of circumferentially spaced radially extending bolts or screws and cooperating nuts.

7. A combustion chamber arrangement as claimed in claim 1 wherein the radially outer axially extending flange being removably secured to the radially outer annular cowl by a second plurality of circumferentially spaced radially extending fasteners, the radially outer annular cowl abutting a radially inner surface of the radially outer axially extending flange and the radially outer annular wall structure abutting a radially outer surface of the radially outer axially extending flange.

8. A combustion chamber arrangement as claimed in claim 7 wherein the second plurality of circumferentially spaced radially extending fasteners comprises a plurality of circumferentially spaced radially extending bolts or screws and cooperating nuts.

9. A combustion chamber arrangement as claimed in claim 1 wherein the radially inner annular structure overlapping the at least one recess in the radially inner axially extending flange.

10. A combustion chamber arrangement as claimed in claim 1 wherein the radially inner annular structure abutting the radially inner surface at a first axial side and a second axial side of the radially inner surface with respect to the at least one recess in the radially inner axially extending flange.

11. A combustion chamber arrangement as claimed in claim 1 wherein an upstream end of the radially inner axially extending flange being tapered, the upstream end of the radially inner axially extending flange decreasing in thickness in an axially upstream direction to a leading edge.

12. A combustion chamber arrangement as claimed in claim 1 wherein an inner diameter of an upstream end of the radially inner axially extending flange being less than an inner diameter of an upstream end of the radially inner annular wall structure.

13. A combustion chamber arrangement as claimed in claim 1 wherein an upstream end of the radially outer axially extending flange being tapered, the upstream end of the radially outer axially extending flange increasing in thickness from a leading edge to a maximum thickness.

14. A combustion chamber arrangement as claimed in claim 13 wherein an outer diameter of the tapered upstream end of the radially outer axially extending flange being greater than an outer diameter of an upstream end of the radially outer annular wall structure.

15. A combustion chamber arrangement as claimed in claim 13 wherein heads of bolts, heads of screws or nuts being located downstream of the tapered upstream end of the radially outer axially extending flange.

16. A combustion chamber arrangement as claimed in claim 1 wherein the radially outer surface of the radially inner axially extending flange having an axial stop for the radially inner annular cowl.

17. A combustion chamber arrangement as claimed in claim 1 wherein a radially inner surface of the radially outer axially extending flange having an axial stop for the radially outer annular cowl.

18. A combustion chamber arrangement as claimed in claim 1 wherein the radially inner annular cowl and the radially outer annular cowl being integral.

19. A combustion chamber arrangement as claimed in claim 1 wherein the radially inner surface of the radially inner axially extending flange having a wear resistant coating.

20. A combustion chamber arrangement as claimed in claim 1 wherein a radially outer surface of an upstream end of the radially inner annular wall structure having a wear resistant coating.

* * * * *